US006964496B2

(12) United States Patent
Yang et al.

(10) Patent No.: US 6,964,496 B2
(45) Date of Patent: Nov. 15, 2005

(54) LAMP MODULE AND BACK LIGHT DEVICE HAVING THE SAME

(75) Inventors: Pang-Lun Yang, Taichung (TW); Ting-Hui Chih, Hualien (TW)

(73) Assignee: BenQ Corporation, Taoyuan (TW)

( * ) Notice: Subject to any disclaimer, the term of this patent is extended or adjusted under 35 U.S.C. 154(b) by 66 days.

(21) Appl. No.: 10/632,025

(22) Filed: Jul. 31, 2003

(65) Prior Publication Data

US 2004/0037073 A1 Feb. 26, 2004

(30) Foreign Application Priority Data

Jul. 31, 2002 (TW) ..... 91117124 A

(51) Int. Cl.[7] ..... F21V 21/00
(52) U.S. Cl. ..... 362/220; 362/225; 362/373
(58) Field of Search ..... 362/220, 217, 362/225, 249, 260, 226, 294, 373

(56) References Cited

U.S. PATENT DOCUMENTS

| | | | | | |
|---|---|---|---|---|---|
| RE30,367 | E | * | 8/1980 | Belokin, Jr. | 439/230 |
| 4,773,111 | A | * | 9/1988 | Hyner et al. | 470/9 |
| 4,949,350 | A | | 8/1990 | Jewell et al. | |
| 5,031,187 | A | | 7/1991 | Orenstein et al. | |
| 5,115,442 | A | | 5/1992 | Lee et al. | |
| 5,138,528 | A | * | 8/1992 | Altman et al. | 361/760 |
| 5,193,098 | A | | 3/1993 | Welch et al. | |
| 5,219,785 | A | | 6/1993 | Welch et al. | |
| 5,256,596 | A | | 10/1993 | Ackley et al. | |
| 5,328,854 | A | | 7/1994 | Vakhshoori et al. | |
| 5,371,661 | A | * | 12/1994 | Simpson | 362/220 |
| 5,594,751 | A | | 1/1997 | Scott | |
| 5,764,674 | A | | 6/1998 | Hibbs-Brenner et al. | |
| 5,893,722 | A | | 4/1999 | Hibbs-Brenner et al. | |
| 6,044,100 | A | | 3/2000 | Hobson et al. | |
| RE36,961 | E | * | 11/2000 | Nagano | 362/219 |
| 6,169,756 | B1 | | 1/2001 | Chirovsky et al. | |
| 6,183,107 | B1 | * | 2/2001 | Donato | 362/238 |

FOREIGN PATENT DOCUMENTS

JP 809845 4/1996

OTHER PUBLICATIONS

Qian, Y. et al., "Long Wavelength (1.3 $\mu$m) Vertical–Cavity Surface–Emitting Lasers With a Wafer–Bonded Mirror and an Oxygen–Implanted Confinement Region," *Appl. Phys. Lett.*, vol. 71, No. 1, (1997), pp. 25–27.

Ridgway, M. C., et al., "Single–Step Implant Isolation of $p^+$–InP with 5–MeV 0 Ions," *Appl. Phys. Lett.*, vol. 60, No. 24, (1992), pp. 3010–3012.

Huffaker, D. L. et al., "Native–Oxide Defined Ring Contact for Low Threshold Vertical–Cavity Lasers," *Appl. Phys. Lett.*, vol. 65, No. 1, (1994), pp. 97–99.

Lee, Y. H. et al., "Top–Surface–Emitting GaAs Four–Quantum–Well Lasers Emitting at 0.85$\mu$m", *Electronics Letters*, vol. 26, No. 11, (1990), pp. 710–711.

Choquette, K. D., et al., "Low Threshold Voltage Vertical–Cavity Lasers Fabricated by Selective Oxidation," *Electronics Letters*, vol. 30, No. 24, (1994), pp. 2043–2044.

Deng, H. and Deppe, D. G., "Oxide–Confined Vertical–Cavity Lser With Additional Etched Void Confinement," *Electronics Letters*, vol. 32, No. 10, (1996), pp. 900–901.

* cited by examiner

*Primary Examiner*—Thomas M. Sember
(74) *Attorney, Agent, or Firm*—Snell & Wilmer L.L.P.

(57) ABSTRACT

A lamp module and a back light device having the lamp module are provided. The lamp module includes a resilient holder, a lamp tube, and a support unit. The resilient holder has an accommodation portion, such as a cavity, for accommodating one end of the lamp tube. The support unit has a reception portion, such as a groove, for engaging with a plug portion of the resilient holder. The support unit has a ditch in one side and the lamp module further includes a conductive element disposed in the ditch for dissipating heat generated by the lamp tube.

25 Claims, 5 Drawing Sheets

LAMP MODULE AND BACK LIGHT DEVICE HAVING THE SAME

CROSS REFERENCE TO RELATED APPLICATIONS

This application claims priority to Taiwan Patent Application No. 091117124 entitled "Lamp Module and Back Light Device Having the Same", filed Jul. 31, 2002.

FIELD OF INVENTION

The present invention generally relates to a lamp module and a back light device having the lamp module, and more particularly, to a lamp module used in a direct type back light device.

BACKGROUND OF THE INVENTION

It has been difficult to miniaturize the volume and the weight of conventional cathode ray tube (CRT) devices, and therefore liquid crystal display (LCD) devices characterized by compact size and excellent image qualities have gradually taken the place of CRT devices. Different from the CRT devices, the LCD device itself does not emit light. A back light source is required in an LCD device to emit lights.

Usually, the back light devices are generally classified into two types: an edge type and a direct type. The edge type back light device includes a lamp typically arranged on an edge side of the LCD device, a light guide plate disposed on a side surface of the lamp, a diffusion film disposed on top of the light guide plate, and a reflection plate disposed on bottom of the light guide plate. The light guide plate scatters rays irradiating from the lamp so that rays are uniformly incident into the diffusion film. The reflection plate reflects rays back to the diffusion plate so that most of the rays from the lamp are uniformly incident to the LCD panel by the diffusion plate.

Comparatively, the direct type back light device does not require a light guide plate. Linear light is directed to the display area from a light source via a diffusion plate and a reflection plate. Therefore, the direct type back light device is widely used in large sized LCD devices because it has high light transmission and does not have a limitation in the size of the display area.

In a conventional direct type back light device, each lamp is individually disposed on the frame or the reflection plate directly. These lamps are unable to be firmly positioned and secured, which results in leakage light or leakage currents, and more seriously, in damage of cables of power. Moreover, arranging the lamps directly on the frame complicates the disassembly procedure of the back light device when it needs repair. The replacement of individual lamp is generally performed in a clean room to reduce contaminations because of the complicated procedure. For example, when a lamp of the conventional back light device used in a LCD television needs to be replaced, the entire back light device has to be disassembled in a clean room, which makes on-site replacement impossible and delays the repair.

Therefore, there is a need to provide a back light module used in a back light device to simplify the assembly procedure and reduce the cost of assembly.

SUMMARY OF THE INVENTION

It is one aspect of the present invention to provide a lamp module and a back light device having the lamp module that reduces the cost of assembly and simplifies the assembly procedure by using a resilient holder to arrange a lamp tube on a support unit.

It is another aspect of the present invention to provide a lamp module for a back light device. The lamp module provides a support unit, which can dissipate heat and support different numbers of lamp tubes based on a variety of design needs.

It is a further aspect of the present invention to provide a lamp module for use with a back light device of a liquid crystal display apparatus. Several lamp tubes are assembled into a module. When certain lamp tubes need to be replaced, on-site replacement of the lamp module is performed without delay of the repair time caused by carrying the back light device to a clean room environment for changing lamp tubes.

In one embodiment of the present invention, a lamp module includes a resilient holder, a lamp tube, and a support unit. The resilient holder has an accommodation portion, such as a cavity, which is provided to accommodate one end of the lamp tube. The support unit has a reception portion, such as a groove, which is provided to engage with the resilient holder. The resilient holder further includes a plug portion, a first clamp portion and a second clamp portion. The plug portion is arranged between the first and second clamp portions, and used to engage with the reception portion of the support unit.

When the resilient holder engages with the support unit, the plug portion is constrained by the first and second clamp portions. The first clamp portion has a thickness larger than that of the plug portion. Further, a ditch is positioned on one side of the support unit in order to dissipate heat. The lamp module further includes a heat conductive element disposed in the ditch to dissipate heat.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION

The present invention discloses a lamp module for use with a back light device of a flat monitor. The lamp module is modulized to simplify the assembly process so as to reduce the cost of assembly.

Figure 1A:
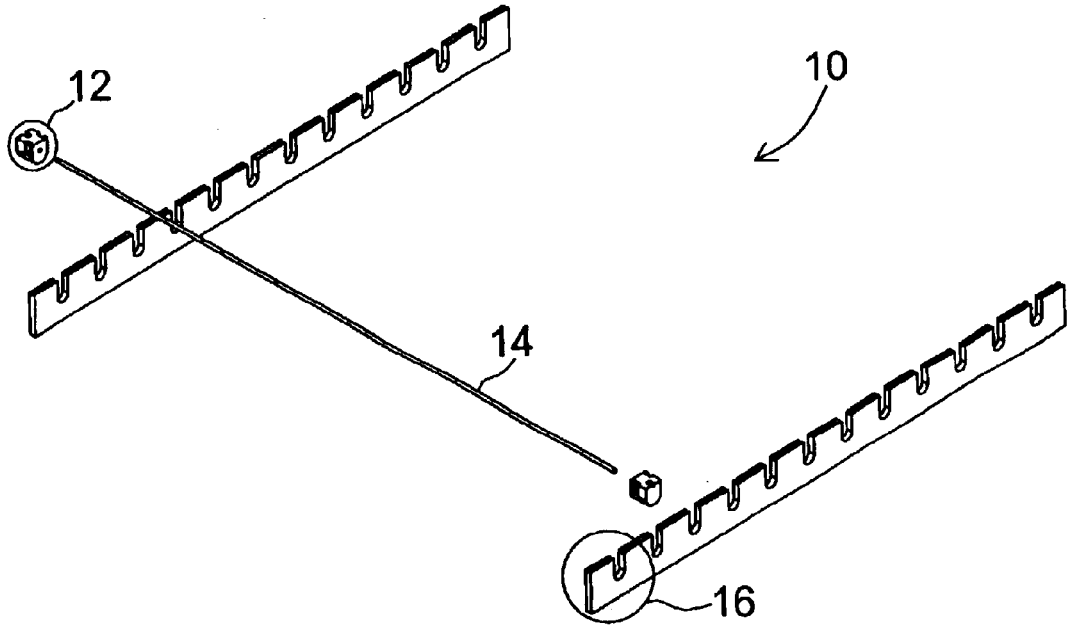
FIG. 1A illustrates an explosive diagram of a lamp module of the present invention.
Figure 1B:
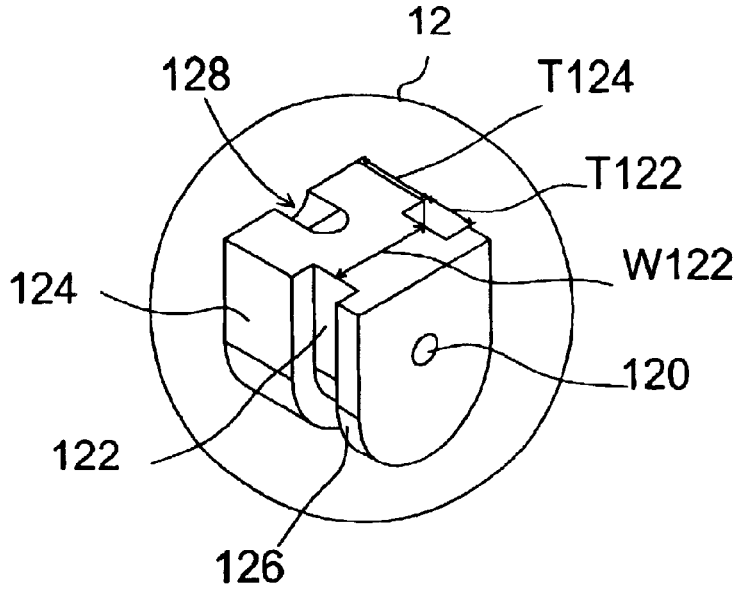
FIG. 1B illustrates an enlarged diagram of a resilient holder of FIG. 1A.
Figure 1C:
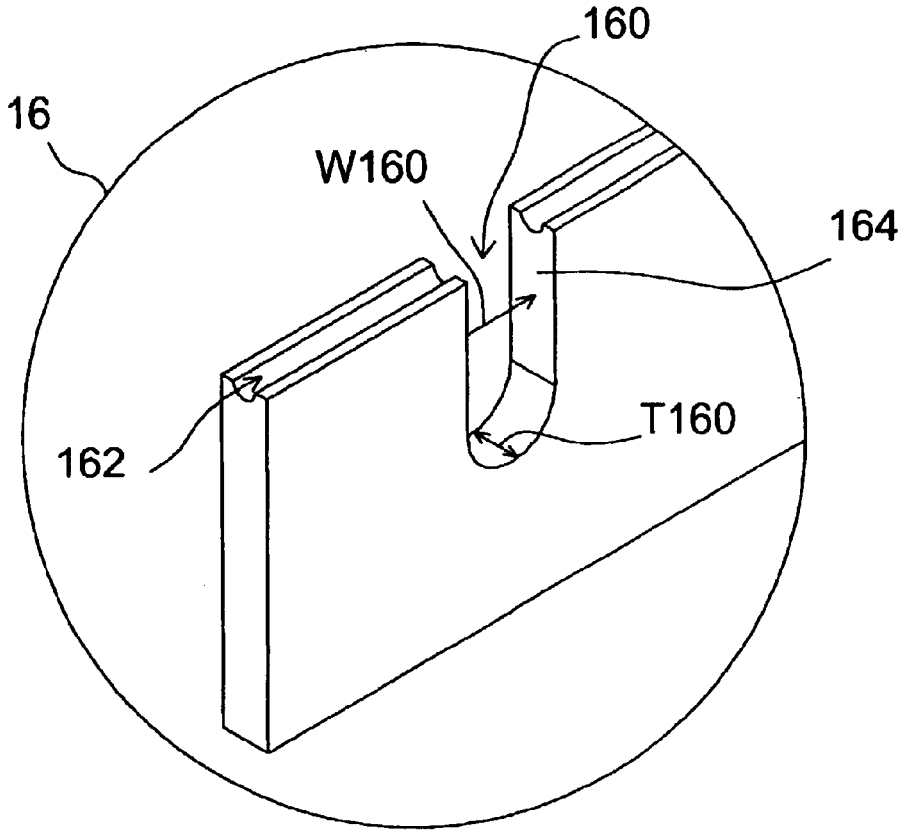
FIG. 1C illustrates an enlarged diagram of a support unit of FIG. 1A.

FIGS. 1A, 1B, and 1C respectively illustrates an explosive diagram and enlarged portions of a lamp module 10 in one embodiment of the present invention. The lamp module 10 includes a resilient holder 12, a lamp tube 14, and a support unit 16. The resilient holder 12 has an accommodation portion 120, such as a cavity, which is provided to accommodate one end of the lamp tube 12. The support unit 16 has a reception portion 160, such as a groove, which is provided to engage with the resilient holder 12. It is noted that in order to position the lamp tube 14, the size of the accommodation portion 120 of the resilient holder 12 is varied according to the outer diameter of the lamp tube 14. For example, when the outer diameter of the lamp tube 14 is ($\phi \pm d$), the inner diameter of the accommodation portion 120 of the resilient holder is ($\phi - d$), so that the lamp tube 14 can be securely accommodated in the accommodation portion 120 of the resilient holder 12. Further, the leakage light or leakage current caused by the shift of the lamp tube 14 is inhibited.

As shown in FIG. 1B, the resilient holder 12 further includes a plug portion 122, a first clamp portion 124, and a second clamp portion 126. The plug portion 122 is arranged between the first and second clamp portions 124 and 126. In this embodiment, the resilient holder 12 is in a U shape. The first and second clamp portions (124 and 126) have a larger outer diameter than that of the plug portion 122. Therefore, the plug portion 122 is shaped like a recess between the first and second clamp portions 124 and 126. When the resilient holder 12 engages with the support unit 16, the plug portion 122 is constrained by the first and second clamp portions 124 and 126.

The shape and the size of the plug portion 122 are varied according to the reception portion 160 so that the plug portion 122 is closely in contact with the rim 164 of the reception portion 160. The reception portion 160 can be a groove 160. For example, the width $W_{122}$ and a thickness $T_{122}$ of the plug portion 122 are varied according to the width $W_{160}$ and thickness $T_{160}$ of the groove 160. When the width $W_{122}$ and thickness $T_{122}$ respectively and substantially equal to the width $W_{160}$ and thickness $T_{160}$, the plug portion 122 tightly engages with the groove 160. The first and second clamp portions 124 and 126 contacting the support unit 16 enhance the engagement, and therefore the plug portion 122 is restricted. Furthermore, the first clamp portion 124, which has a thickness $T_{124}$ larger than the thickness $T_{122}$ of the plug portion 122, provides a clamp force with respect to the stationary function provided by the second clamp portion 126. Moreover, to enhance the strength of the resilient holder 12, the thickness $T_{124}$ of the first clamp portion 124 is preferably about 1.5 to 2 times larger than the thickness $T_{122}$ of the plug portion 122.

The resilient holder 12 can be made of rubber or any materials as appropriate and made by, for example, an injection mold process. The resilient holder 12 further includes a channel 128 for allowing a cable (not shown) to pass through it and connects the lamp tube 14, and therefore the arrangement and connection of the cable are readily achieved. It is noted that though the resilient holder 12 is in a U shape in this embodiment, but it is not limited to this shape. The lamp tube 14 can be but not limit to, for example, a cold cathode fluorescent lamp (CCFL). The type and the shape of the lamp tube 14 are not limited to those of the exemplary embodiment.

Figure 1D:
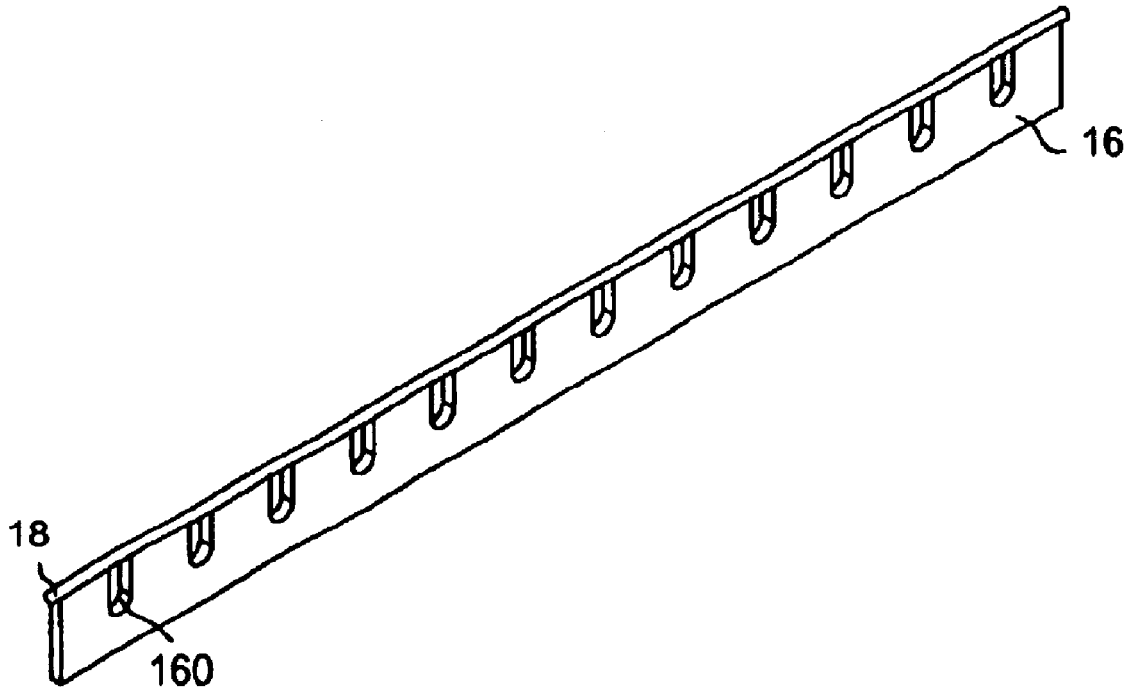
FIG. 1D illustrates a conductive element disposed on the support unit of FIG. 1A.

As shown in FIG. 1C, the support unit 16 further includes a ditch 162 in one side that is configured to dissipate heat. For example, the heat generated by the lamp tube 14 can be dissipated through the ditch 162 to two ends of the support unit 16. As shown in FIG. 1D, the lamp module 10 further includes a heat conductive element 18 disposed in the ditch 162 in order to dissipate heat. The heat conductive element 18 can be made of metal, such as copper, to dissipate heat generated by the lamp tube 14. It is noted that FIG. 1D is illustrated to explain the arrangement of the heat conductive element 18 and the support unit 16, and therefore the resilient holder 12, which engages with the support unit 16 in practical applications, is not illustratively included. Furthermore, the shape of the resilient holder 12 can be modified with respect to the implement of the heat conductive element 18. For example, when the resilient holder 12 engages with the support unit 16, the resilient holder 12 can have a recess consistent with the ditch 162 to accommodate the heat conductive element 18. Generally, the design rule includes: the resilient holder 12 can engage with the reception portion 160 but not block the path of ditch 162.

Figure 2:
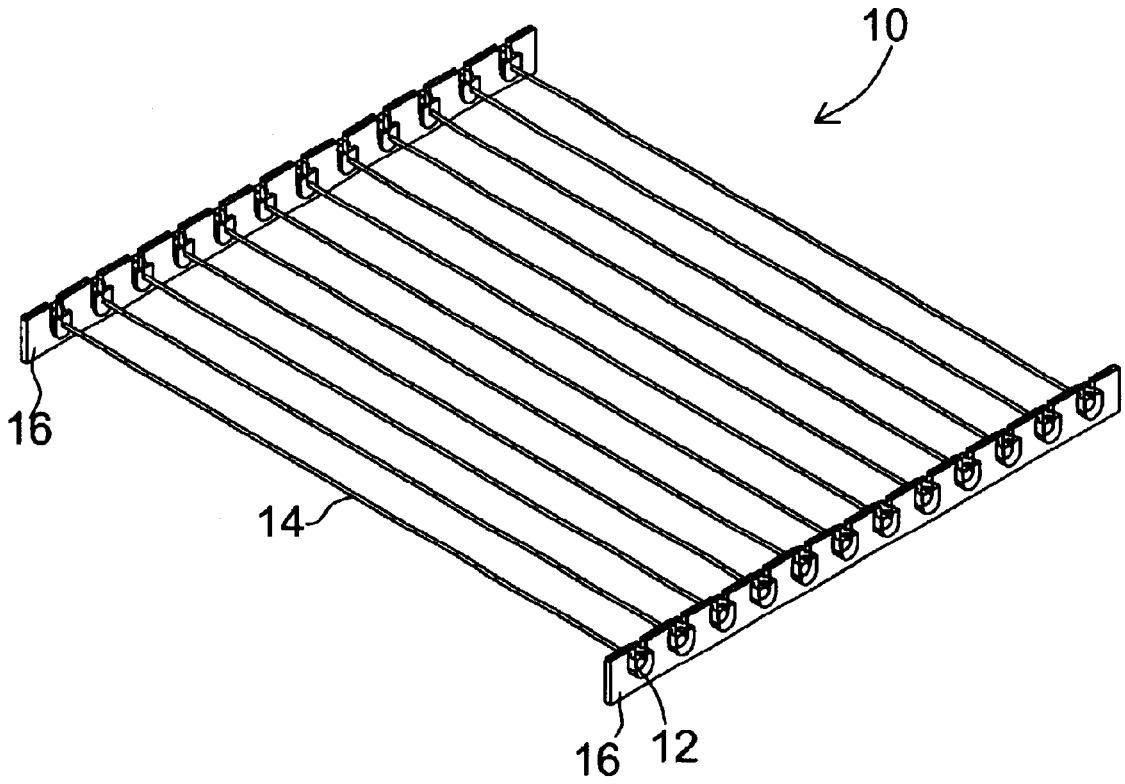
FIG. 2 illustrates a lamp module in one embodiment of the present invention.

FIG. 2 illustrates an assembled view of the lamp module 10, in which several lamp tubes 14 are integrated into a module, which can be used in a back light device of an LCD monitor. According to different design needs, the number of lamp tubes 14 can be modified without re-designing the frame of the back light device. For example, when the number of the lamp tubes 14 is modified, accordingly, only modification of the number of the reception portion 160 of the support unit 16 or re-arrangement of the lamp tubes 14 is necessary.

Figure 3:
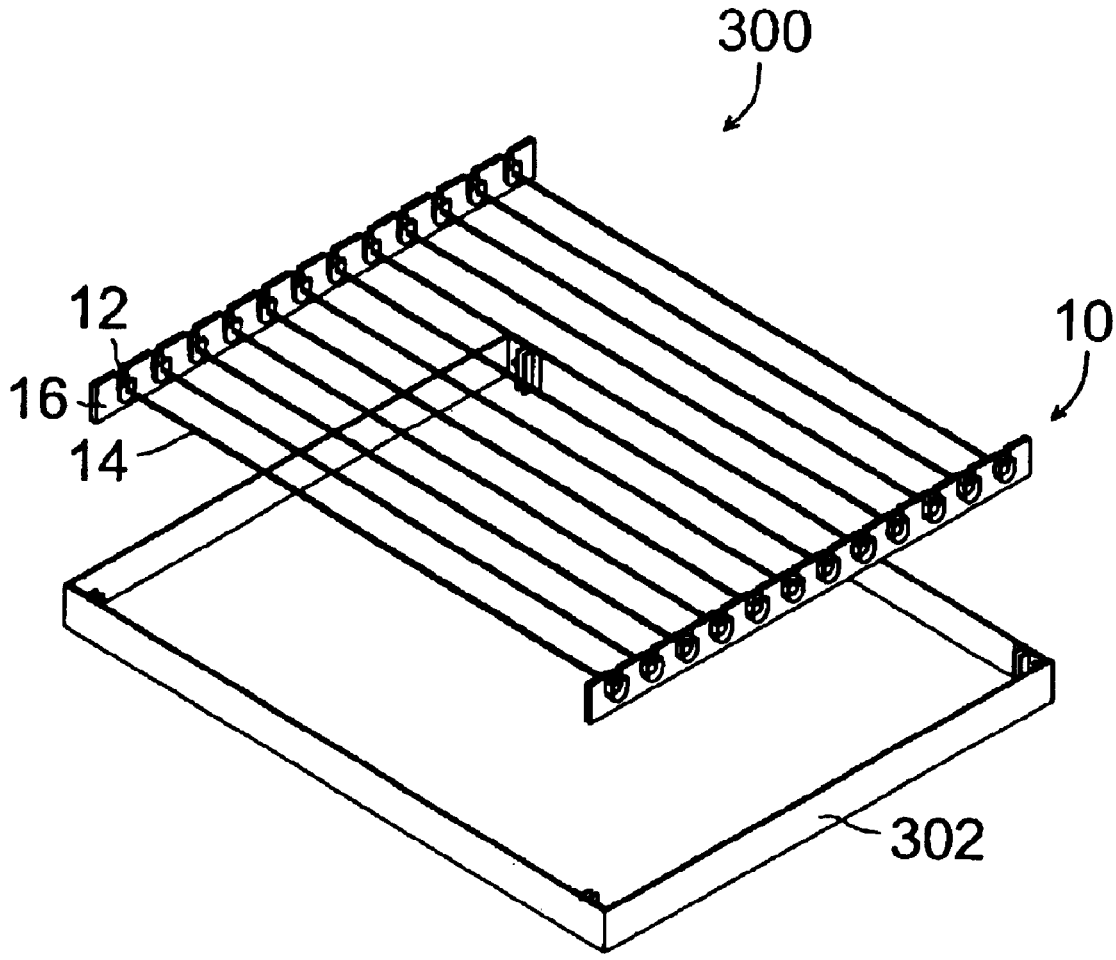
FIG. 3 illustrates a back light device of the present invention.

FIG. 3 illustrates a back light device 300 having the lamp module 10 of the present invention. As shown in FIG. 3, lamp tubes 14 are modularly assembled in frame 302 of the back light device 300 to provide for efficient repair compared to a conventional back light device having lamp tubes 14 fixed on the frame. In other words, when lamp tubes 14 of the back light device 300 need to be replaced, on-site replacement of the lamp module 10 is performed without delay of the repair time caused by carrying the back light device 300 including the frame 302 to a clean room for changing lamp tubes 14.

Although specific embodiments have been illustrated and described, it will be obvious to those skilled in the art that various modifications may be made without departing from what is intended to be limited solely by the appended claims.

We claim:

1. A lamp module for use in a back light device, comprising:

a resilient holder having a first clamp portion, a second claim portion, a plug portion, an accommodation portion, and a channel, said plug portion being positioned between said first and second clamp portions;

a lamp tube having one end accommodated in said accommodation portion of said resilient holder; and a support unit having a reception portion provided to engage with said plug portion of said resilient holder, wherein said channel allows a cable to pass through to connect to said lamp tube, and said plug is constrained by said first and second clamp portions when said resilient holder engages with said support unit.

2. The lamp module of claim 1, wherein said accommodation portion of said resilient holder is a cavity.

3. The lamp module of claim 1, wherein said reception portion of said support unit is a groove.

4. The lamp module of claim 1, wherein said first clamp portion has a first thickness and said plug portion has a second thickness, and said first thickness is larger than said second thickness.

5. The lamp module of claim 4, wherein said first thickness is about 1.5 to 2 times larger than said second thickness.

6. The lamp module of claim 1, wherein a ditch is formed on one side of said support unit to dissipate heat.

7. The lamp module of claim 6, wherein a heat conductive element is disposed in said ditch to dissipate heat.

8. The lamp module of claim 7, wherein said heat conductive element is made of metal.

9. The lamp module of claim 8, wherein said heat conductive element is a copper rod.

10. A lamp module for use in a direct type back light device, comprising:

a resilient holder having a cavity, a first clamp portion, a second clamp portion and a plug portion, said plug portion being positioned between said first and second clamp portions;

a lamp tube having one end accommodated in said cavity of said resilient holder; and a support unit having a groove provided to engage with said plug portion of said resilient holders, wherein said plug portion is constrained by said first and second clamp portions when said resilient holder engages with said support unit.

11. The lamp module of claim 10, wherein said first clamp portion has a first thickness and said plug portion has a second thickness, and said first thickness is larger than said second thickness.

12. The lamp module of claim 11, wherein said first thickness is about 1.5 to 2 times larger than said second thickness.

13. The lamp module of claim 10, wherein said resilient holder includes a channel for allowing a cable to pass through to connect said lamp tube.

14. The lamp module of claim 10, wherein a ditch is positioned on one side of said support unit to dissipate heat.

15. The lamp module of claim 14, wherein a heat conductive element is disposed in said ditch to dissipate heat.

16. A lamp module for use in a back light device, comprising:

a resilient holder having a first clamp portion, a second clamp portion, a plug portion, and an accommodation portion, said plug portion being positioned between said first and second clamp portions;

a lamp tube having one end accommodated in said accommodation portion;

a support unit having a reception portion provided to engage with said plus portion of said resilient holder; and a heat conductive element for dissipating heat disposed in a ditch on one side of said support unit, wherein said plug portion is constrained by said first and second clamp portions when said resilient holder engages with said support unit.

17. The lamp module of claim 16, wherein said reception portion is a groove.

18. The lamp module of claim 16, wherein said first clamp portion has a first thickness and said plug portion has a second thickness, and said first thickness is larger than said second thickness.

19. The lamp module of claim 16, wherein said resilient holder includes a channel for allowing a cable to pass through to connect to said lamp tube.

20. A lamp module for use in a back light device, comprising:

a resilient holder having an accommodation portion, a first clamp portion, a second clamp portion and a plug portion, said plug portion being positioned between said first and second clamp portions;

a lamp tube having one end accommodated in said accommodation portion; and a support unit having a reception portion provided to engage with said resilient holder, wherein said plug portion is constrained by said first and second clamp portions when said resilient holder engages with said support unit.

21. The lamp module of claim 20, wherein said reception portion is a groove, and said plug portion engages with said groove.

22. The lamp module of claim 20, wherein said first clamp portion has a first thickness and said plug portion has a second thickness, and said first thickness is larger than said second thickness.

23. The lamp module of claim 20, wherein said resilient holder includes a channel for allowing a cable to pass through to connect to said lamp tube.

24. The lamp module of claim 20, wherein a ditch is formed on one side of said support unit to dissipate heat.

25. The lamp module of claim 24, wherein a heat conductive element is disposed in said ditch to dissipate heat.

* * * * *